US005549079A

United States Patent [19]

Johnston, Jr. et al.

[11] Patent Number: 5,549,079

[45] **Date of Patent: *Aug. 27, 1996**

[54] OPEN BEAM SOOTBLOWER

[75] Inventors: Jesse C. Johnston, Jr., Carroll; James S. Kulig; Steven F. Lewis, both of Lancaster; Eric C. Collet, Columbus; Mark J. Sepela, Reynoldsburg; Michael L. Meuller, Circleville, all of Ohio

[73] Assignee: The Babcock & Wilcox Company, New Orleans, La.

[ * ] Notice: The term of this patent shall not extend beyond the expiration date of Pat. No. 5,429,076

[21] Appl. No.: 440,317

[22] Filed: May 12, 1995

Related U.S. Application Data

[63] Continuation of Ser. No. 189,301, Jan. 28, 1994, Pat. No. 5,421,076, which is a continuation-in-part of Ser. No. 34,251, Mar. 22, 1993, Pat. No. 5,299,533.

[51] Int. Cl.[6] ..... F22B 37/18

[52] U.S. Cl. ..... 122/379; 122/382; 122/390; 122/392; 15/316.1; 15/317

[58] Field of Search ..... 122/379, 382, 122/390, 392; 15/316.1, 317

[56] References Cited

U.S. PATENT DOCUMENTS

| | | | |
|---|---|---|---|
| 4,803,959 | 2/1989 | Sherrick et al. | 122/379 |
| 5,429,076 | 7/1995 | Johnston, Jr. et al. | 122/379 |

*Primary Examiner*—Henry A. Bennett
*Assistant Examiner*—Siddharth Ohri
*Attorney, Agent, or Firm*—Harness, Dickey & Pierce, P.L.C.

[57] ABSTRACT

A retractable sootblower having an open frame. The frame includes an inboard end wall, an outboard end wall and a pair of opposingly positioned side panels. The side panels are seamless and mounted to interconnect the inboard and outboard end walls together. The side panels cooperating with the end walls to generally define a rectangularly shaped structure which encloses the carriage and lance tube of the sootblower. The generally open top and bottom of the frame allows for substantially unobstructed access from above and below to the carriage and lance tube. The sootblower also includes a dry lance hub which eliminates various problems associated with lubricant deterioration.

12 Claims, 8 Drawing Sheets

70
232
222
232
70
224
224
30
30
28
28
72
72
220
220
218
214

OPEN BEAM SOOTBLOWER

CROSS REFERENCE TO RELATED APPLICATION

This application is a continuation of U.S. Patent application Ser. No. 08/189,301, filed Jan. 28, 1994, now U.S. Pat. No. 5,429,076 which is a continuation-in-part of prior application Ser. No. 08/034,251 filed on Mar. 22, 1993, now U.S. Pat. No. 5,299,533 and entitled OPEN BEAM SOOTBLOWER.

BACKGROUND AND SUMMARY OF THE INVENTION

This invention generally relates to sootblowers and particularly relates to improvements in the frame structure and drive mechanism of a retractable sootblower.

Sootblowers are used to project a stream of blowing medium, such as water, air or steam, against heat transfer surfaces within large scale boilers or other heat exchangers to cause slag and ash encrustations to be removed. The impact of the blowing medium produces mechanical and thermal shock which causes the adhering encrustation layers to be removed.

One general category of sootblowers is known as the long retracting type. These devices have a retractable lance tube which is periodically advanced into and withdrawn from the boiler and which is simultaneously rotated such that one or more nozzles at the end of the lance tube project jets of blowing medium against the encrusted surfaces in the boiler.

Sootblower designers are constantly striving to enhance design efficiency in terms of construction cost, operation, inventory cost and maintenance. In a conventional retractable sootblower, an elongated frame or beam houses a moveable carriage. The carriage drives a lance tube from one end of the frame to the other during the extension and retraction motion. Various configurations for sootblower frames are known.

In One well-known configuration, sheet metal plate stock is press brake formed to define three sides of a generally rectangular shaped member defining the elongated frame. In a typical installation, the open portion of the frame faces downward. The carriage is driven to move within the frame and the frame supports the lance tube suspended therein. Such conventional sootblower frames are known as closed frames since their upper surface is enclosed and inaccessible. Examples of presently known sootblower designs are provided with reference to U.S. Pat. Nos. 2,668,978; 3,439,376; 3,585,673; 3,604,050, 4,229,854 and 4,351,082. Although these closed frame type sootblowers perform in a satisfactory manner, they do have certain drawbacks.

One drawback results from the method in which the frame is formed. Since the three sided frame member is brake formed from flat sheet metal stock, a limitation on the length (typically twenty feet) of the member is presented by the brake forming machine. To form a longer frame member, separate three sided members are butt welded together. Obviously, forming the butt welds requires an additional and separate bonding step to be included in the production operation. Additionally, the presence of the weld is a site for corrosion development.

In certain sootblower applications, it is difficult to service the various mechanisms of the unit through the open bottom portion of the above mentioned closed frame. In these applications, a frame having an open upper portion which would allow the carriage, feed tube, lance tube and drive or gear rack to be removed by withdrawing them up through the top portion of the sootblower frame would be more desirable. Although such open top sootblowers can be produced, when using conventional constructions, specifically designed units would have to be produced for specific installation sites.

Another problem associated with previous types of sootblower frames is the manner in which they are supported at the installation site or plant. Typically, brackets are welded at the installation site onto the sidewalls of the frame at a distance, approximately three to four feet, from the rear bulkhead. The frame is then field welded to various support structures of the plant itself. As a result, the entire weight of the sootblower is being supported by the sidewalls of the beam or frame. This includes not only the weight of the lance tube, the carriage and the beam, but also the weight of the supply piping extending from the poppet valve, sometimes eighty feet below the location of the sootblower assembly itself. The net effect of the piping loads, the carriage weight, the lance tube weight and the other forces generated during cleaning is that the sidewalls of the frame may undergo deflection and develop a permanent set thereby negatively affecting the performance of the sootblower, Yet another problem associated with sootblowers is that as steam flows through the lance tube, high temperatures are generated within the carriage housing. These temperatures can cause a decrease in life of lubricants. Often, the lubricant which is used to lubricate the bearings supporting the lance hub is also the lubricant used to lubricate the various gears of the carriage's transmission which provides translational and rotational movement of the lance tube. The heat generated within the lance hub thus affects all of the lubricant utilized by the sootblower. In such a carriage housing, significant attention needs to be paid to the condition of the lubricant to ensure that it is in good condition and that serous damage does not occur to the carriage transmission or bearings supporting the lance hub.

With the above limitations in mind, it is an object of this invention to provide a sootblower having a frame which features an open construction and enables the sootblower components to be readily serviced or withdrawn through the bottom or the top of the unit.

Another object of this invention is to provide a frame for a sootblower which can be constructed to any desired length while using a common inventory stock for all lengths. It is also an object to provide a sootblower frame in which the side panels are seamless and formed with a unitary construction.

Still another object of the invention is to provide a sootblower frame which is resistant to corrosion and which is easily inspected for corrosion damage.

Yet another object of the present invention is to provide a sootblower frame which is less susceptible to damage resulting from deflection of the frame under the weight and forces, including piping loads, associated with operation of the sootblower. A related object is to provide and support a frame which is capable of handling an increase in piping weight.

Another primary object of this invention is to decrease the frequency between required servicing of the lubricant used in the sootblower. In particular, the present invention thermally isolates the lubricant used in connection with the various carriage transmission components from the heat transmitted through the lance hub and from the lubricant associated with the lance hub. By doing this, the useful life of the transmission lubricant, as well as the various transmission components themselves, is prolonged. In further achieving the above mentioned object, the present invention also has as one of its objects providing a sootblower in which the lance hub is retained in what may be referred to as a non-lubricated or permanently lubricated fashion. As used herein, these terms are intended to include mountings which eliminate the need to service the lubricant typically required with the prior art.

The various boiler configurations require retractable sootblowers of varying lengths. Such lengths range from only several feet long to ones well in excess of sixty feet. With conventional sootblower designs, the vast difference in size requirements has restricted the use of a common construction component for all the varying lengths of possible sootblower applications. This increases a manufacturer's inventory requirements and adversely affects component costs.

The use of common components for various lengths of sootblowers becomes difficult since significantly different loads will act on the frame structure as a function of its length. For example, as the extended length of the lance tube increases, the loads applied to the frame changes. In addition, significant loads, from both gravity and fluid reaction forces, act on the sootblower lance tube as the sootblower performs its cleaning function. These loads are transferred to the sootblower carriage which is restrained by the frame.

Various designs for an open-type sootblower frame have been proposed. However, such devices are typically costly to manufacture and do not offer a high degree of accessibility since they are generally constructed to provide either top access or bottom access, but not both. Additionally, in an effort to achieve the necessary structural rigidity, closed box sections or tubes have been proposed which are welded to side panels to form ribs bridging the side panels. These closed tubes have also been used to define the side panels themselves. Although the closed tubes would provide adequate structural integrity, they too are available only in certain lengths and require butt welds or cutting to achieve the appropriate lengths. This again involves extra costs and waste. Moreover, closed box tubes are disadvantageous in that they cannot readily be inspected or protected from corrosion. Also, in order to keep their weight at an acceptable level, the metal thickness of the box tube sections must be kept relatively thin. This further degrades corrosion protection.

The sootblower frame in accordance with this invention is readily adapted for different lengths of sootblowers by using various lengths of flat sheet metal for the side panels of the frame. With the shorter sootblower lengths (up to approximately twenty-two feet)the sheet metal side panels can be used without further structural reinforcement. For intermediate lengths, angle iron is welded or bolted along the length of the side panels of the frame to increase its structural integrity and enable it to handle the loads associated with the longer length lance tube. The longest length devices, those generally having a length greater than twenty-two feet to thirty-four feet, require further reinforcing by adding an additional strengthening member to the side panels of the frame.

As mentioned previously, the requirements of joining separate lengths of stock material together to form a sootblower frame of a desired length has its disadvantages. In accordance with this invention, a sootblower frame is provided in which the side panels can be formed from coiled sheet metal stock, available in substantially any length required. Since the side panels do not require forming of any type, with the exception of a flattening or straightening operation, length constraints are virtually eliminated and the side panels can be formed without seams thereby eliminating an inherent weakness of the prior designs.

In some prior sootblowers, a pair of laterally separated guide tracks or rails are provided to suspending the carriage as it moves between its advanced and retracted positions. Frequently, the lance tube is designed to be positioned off-center with respect to the two guide rails. This is known as handedness, left-handedness or right-handedness depending to which side of the lance tube is off-set.

Due to the significant fluid force of the blowing medium acting on the cross-section of the feed tube, substantial pressure forces also act on the carriage and the frame. When handedness is designed into the sootblower, significant imbalances in the forces applied are present. This leads to increased and uneven structural loading on both the frame and carriage.

In one embodiment of the present invention, the sootblower features a balanced orientation with the lance tube being equidistantly positioned between the side tracks thus equalizing the loading of the frame.

The sootblower of the present invention also incorporates an integral rear support as opposed to those prior sootblowers having field welded support brackets on their sidewalls. The rear support of the present invention is provided as an extension of the rear bulkhead. This results in the sidewalls being less stressed and being less likely to deflect or deform. It also enables the sootblower to support increased piping loads without negatively affecting the poppet valve or feed tube designs.

Yet another feature of the present invention is the isolation of the lance hub from the remainder of the carriage assembly and particularly the incorporation of a "dry" lance hub bearing into the sootblower. By isolating the lance hub from the remainder of the carriage assembly, the heat generated by the steam passing through the lance hub is prevented from significantly heating the lubricant of the carriage assembly. The design of the present invention enhances the convective dissipation of heat from the exterior of the lance hub to the surrounding area. The hub itself is rotationally supported in pillow blocks by permanently lubricated specially designed bushings having a high temperature resistance. In addition to requiring no additional lubrication, the bushings allow the lance tube to rotate while constraining thrust loads induced by the steam or blowing medium flowing through the lance tube. Thus, combining the bushings with the enhanced convective cooling allows the lance hub to be rotationally supported without needing an additionally or externally applied lubricant at the bushings.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE PREFERRED EMBODIMENTS

Figure 1:
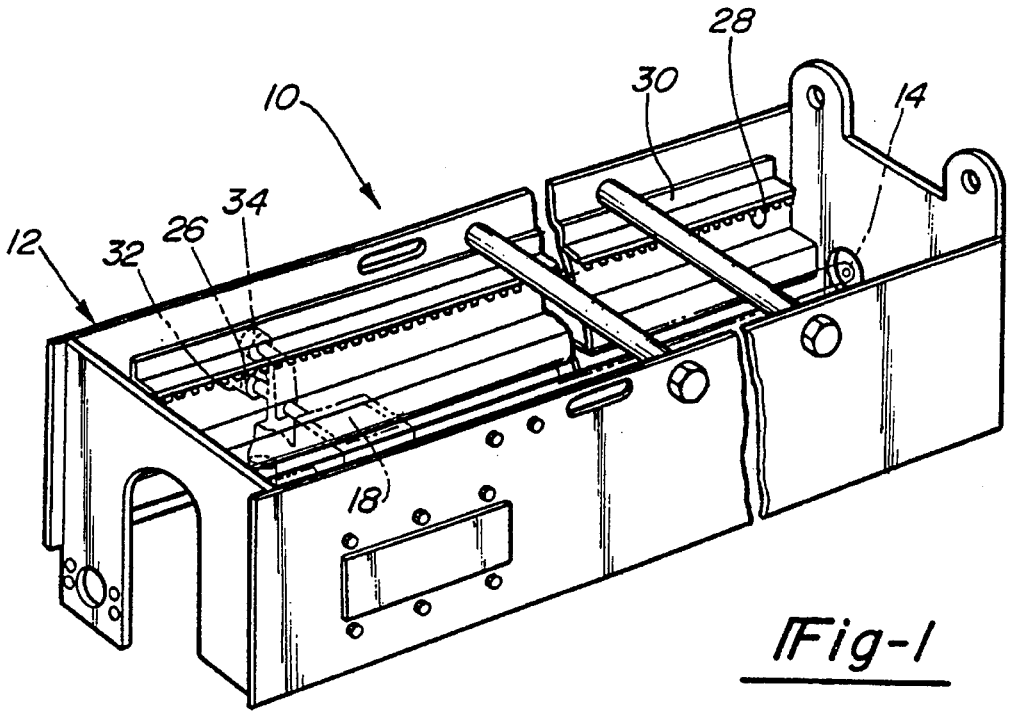
FIG. 1 is a pictorial view showing a long retracting sootblower incorporating the features of the present invention.

A sootblower including the improvements of the present invention is shown in FIG. 1 and generally designated therein by reference number 10. The sootblower 10 principally comprises a beam or frame 12, a lance tube 14 and a carriage 18 (the carriage 18 and the lance tube 14 are shown in phantom). As seen in FIG. 1, the sootblower 10 is in its resting or retracted position. Upon actuation, the carriage 18 is advanced relative to the frame 12 causing the lance tube 14 to be extended into and subsequently retracted from a boiler (not shown).

Generally, the lance tube 14 is simultaneously rotated as it is advanced and retracted in and out of the boiler. The carriage 18 drives the lance tube 14 into and out of the boiler and includes a drive motor, drive train and gear box (not shown) which are enclosed by the housing of the carriage. A drive system of the general type described above is disclosed in U.S. Pat. No. 5,065,472 which is commonly assigned to the Assignee of the present invention and hereby incorporated by reference. The drive motor drives a pair of pinion gears 26 which engage toothed racks 28 to advance the carriage 18 and the lance tube 14. The toothed racks 28 are respectively supported by a pair of tracks 30 connected to the frame 12 as further discussed below.

Often, a poppet valve is used to control the supplying of blowing medium to the sootblower 10. The poppet valve may be actuated through a linkage which is engaged by the carriage 18 during extension of the lance tube 14 to begin the discharge of the blowing medium. Similarly, the flow of blowing medium is cut off once the lance tube 14 and carriage 18 have returned to their fully retracted position.

A coiled electrical cable (not shown) conducts power to the drive motor as it moves with the carriage 18. A front support bracket (not shown), which includes rollers and bearings, is generally used to support the lance tube 14 during its longitudinal and rotational motion. For long lance tube lengths, an intermediate support, also having rollers and bearings, may be required to prevent excessive bending deflection of the lance tube 14. Additional details of the construction of a well known "IK" sootblower are found in U.S. Pat. No. 3,439,376, issued to the Assignee of the present invention and herein incorporated by reference.

Figure 2:
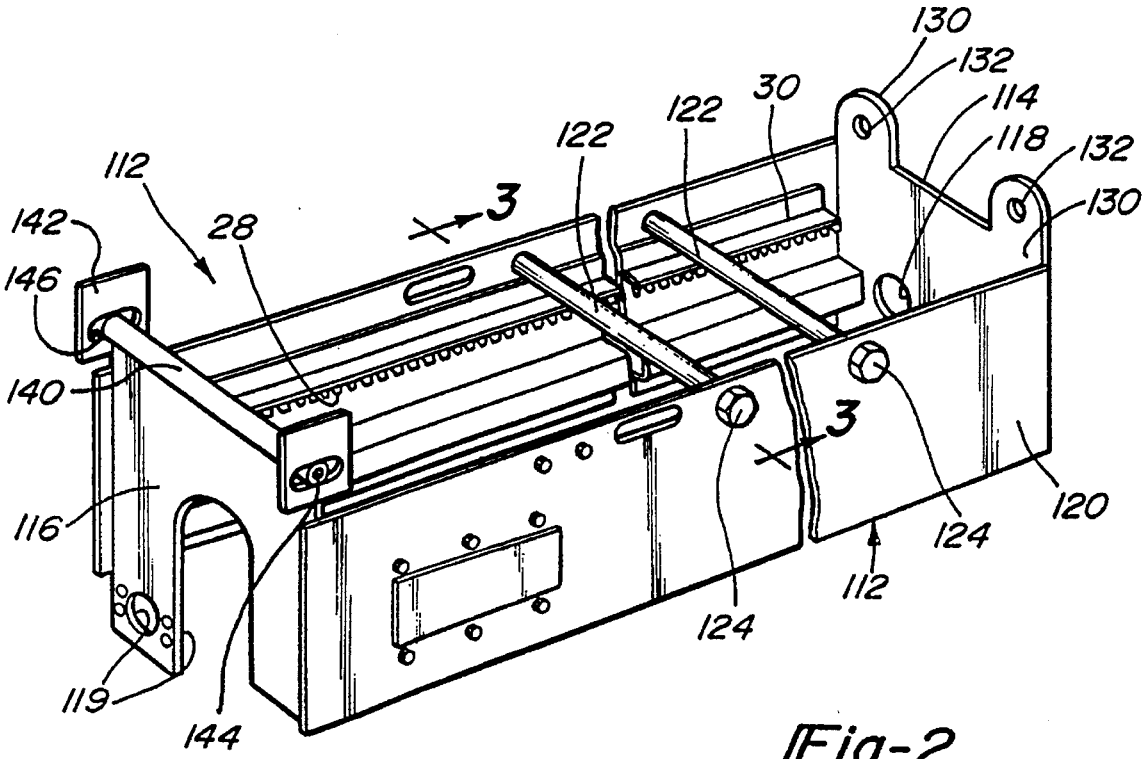
FIG. 2 is a perspective view of an open sootblower frame according to the principles of this invention and as generally seen in FIG. 1 with the carriage assembly and various related components being omitted.

Referring now to FIG. 2, a first embodiment of an open sootblower frame 112, embodying the principles of the present invention, is shown therein. The frame 112 of this embodiment is intended to be used in retro-fit applications where the carriage 18 and lance tube 14 display left or right handedness such that the lance tube 14 is offset from the centerline of the frame 112.

The frame 112 has a generally rectangular box-shaped configuration which is open at its top and bottom for easy access to the carriage 18 and the lance tube 14. The closed portions or sidewalls of the frame 112 include an inboard end wall (front bulkhead) 114, an outboard end wall (rear bulkhead) 116 and side panels 120. The inboard end wall 114 is adapted for securement to the boiler wall or a wall box and includes a lance opening 118 which provides the lance tube 14 with access to a port in the boiler wall and the interior of the boiler itself. The outboard end wall 116 is positioned away from the boiler wall and can be provided with openings 119 that permit rear access to various features of the sootblower 10 when the carriage 18 is in its retracted position. The inboard and outboard end walls 114 and 116 are constructed from coiled sheet metal stock which has been flattened. Alternatively, these end walls can be manufactured from sheet metal plate stock which is easily cut the size or otherwise fabricated.

Extending between the inboard end wall 114 and the outboard end wall 116 are the sidewalls or side panels 120. The side panels 120 are formed from coiled sheet metal stock which has been flattened and cut to an appropriate size for the desired sootblower 10 length. Preferably, the side panels 120 have an approximate thickness of 5/16 of an inch which provides a significant amount of strength for most frame lengths, yet being easily reinforced for longer lengths. This thickness also provides a substantial amount of resistance to corrosion. By constructing each side panel 120 from one seamless or unitary piece of metal, the need for butt welding a number of individual panels together, along with the associated limitations, to form a long side panel is eliminated. Additionally, by eliminating the need for various side panel lengths, a manufacturer can significantly reduce the need for a large on-hand inventory stock and the costs associated with keeping a large amount of varying inventory.

In constructing the open frame 112 of the present invention, a desired length of coiled sheet metal stock is unrolled, flattened, straightened and cut to length for each side panel 120 of the frame 112. The end walls 114 and 116 are similarly fabricated, Each side panel 120 is then welded to opposing sides of the inboard and outboard end walls 114 and 116 to form a generally rectangularly shaped box having an open top and bottom.

Figure 3:
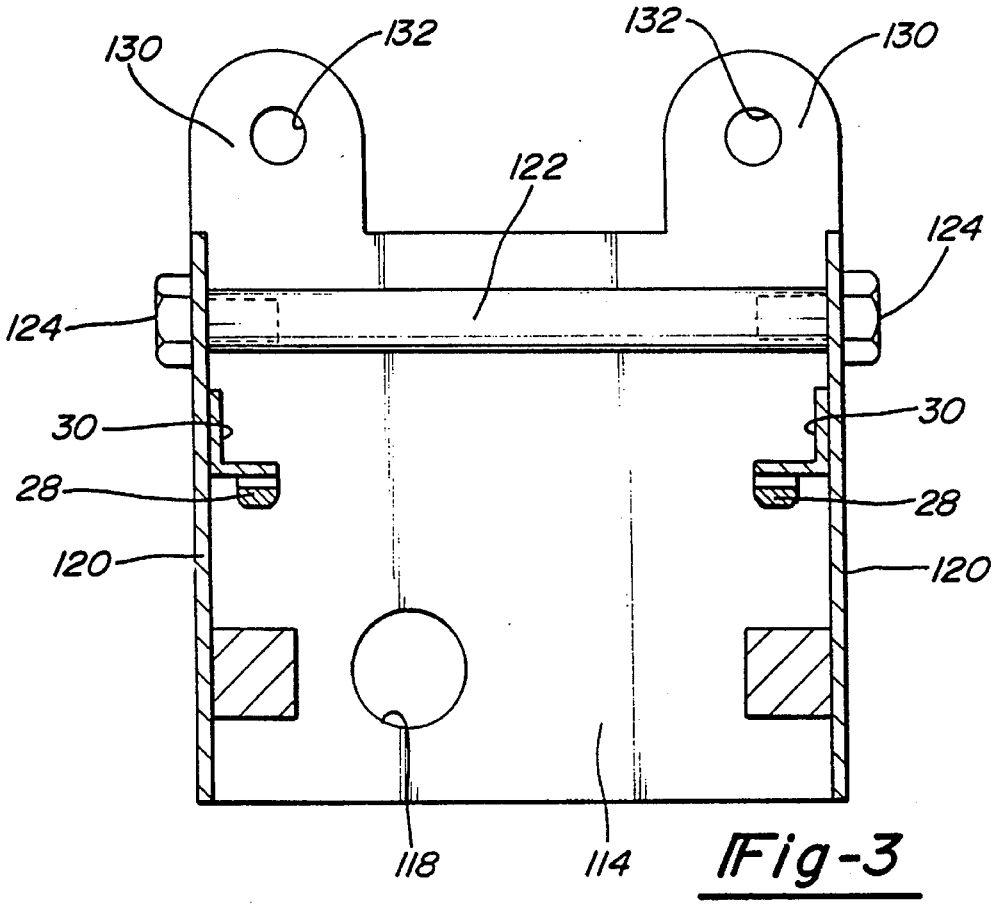
FIG. 3 is a sectional view taken substantially along line 3—3 in FIG. 2 showing one embodiment of the open sootblower frame of the present invention.

At various positions along its length, the frame 112 is provided with struts 122 that extend between the side panels 120. In the illustrated embodiment, the struts 122 are secured along an edge, preferably the upper edge, of the side panels so that they can be readily removed to provide substantially unobstructed access to the various components of the sootblower 10 for servicing while installed within the frame 112. As seen in FIGS. 2 and 3, the struts 122 extend between the inside surfaces of the side panels 120 and are secured by threaded fasteners or bolts 124 extending through the side panels 120 directly into the struts 122 themselves. The struts 122 can be formed from a number of different materials, including metal rod stock, and can have a number of different configurations. In the illustrated embodiment, the struts 122 are round bars having threaded bores in each end for receiving the bolts 124. If it is known that the particular sootblower being retrofitted is typically or more easily serviced from the top or the bottom, non-removable struts 122 can be installed along the top or bottom, which ever is serviced less.

The rear bulkhead 116 is also provided to operate as the rear support for the frame 112 thereby decreasing the stressing of the side panels 120. To accomplish this, the upper edge of the rear bulkhead 116 is provided with a transversely extending mounting bar 140 that may be welded or otherwise secured to the bulkhead 116. Slotted brackets 142 are secured to the ends of the mounting bar 140 by fasteners 144, such as bolts, extended through an adjustment slot 146 in the bracket 142 and into the end of the mounting bar 140.

Depending from the various structures located at the installation site for the sootblower 110, the mounting bar 140 and brackets 142 operate as a mechanism for adjustably securing and supporting the frame 112. Obviously, the brackets 142 are intended to be welded or otherwise secured to existing or provided structures at the site where the sootblower 10 is to be installed, with the slots 146 allowing adjustability and versatility in this mounting.

Figure 4:
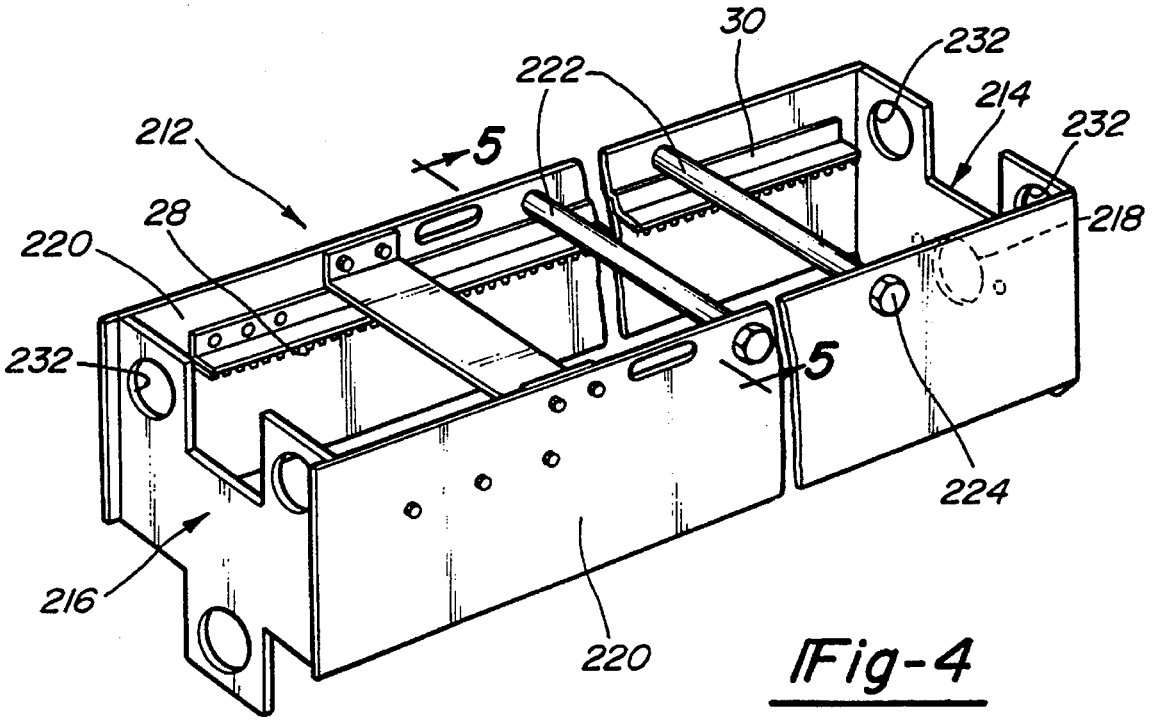
FIG. 4 is a perspective view of another embodiment of the open sootblower frame according to the principles of the present invention.

A second embodiment of the present invention is generally illustrated in FIG. 4. The frame 212 of this second embodiment is generally similar to the first embodiment in that it includes inboard and outboard end walls 214 and 216, as well as a pair of opposing, seamless side panels 220. One distinction, however, is that the frame 212 is intended to be used with a sootblower that does not exhibit left or right handedness. For this reason, the lance opening 218 of the inboard end wall 214 is substantially centered with respect to the side panels 220 and the inboard end wall 214. The non-handed or balanced sootblower results in more even reaction forces being applied to both of the frame side panels 220 during cleaning of the boiler.

Removable struts 222, made from round bar stock and secured by bolts 224, extend between the side panels 220 again providing substantially unobstructed access to a carriage 18 within the frame 212 for easy servicing.

Figure 5:
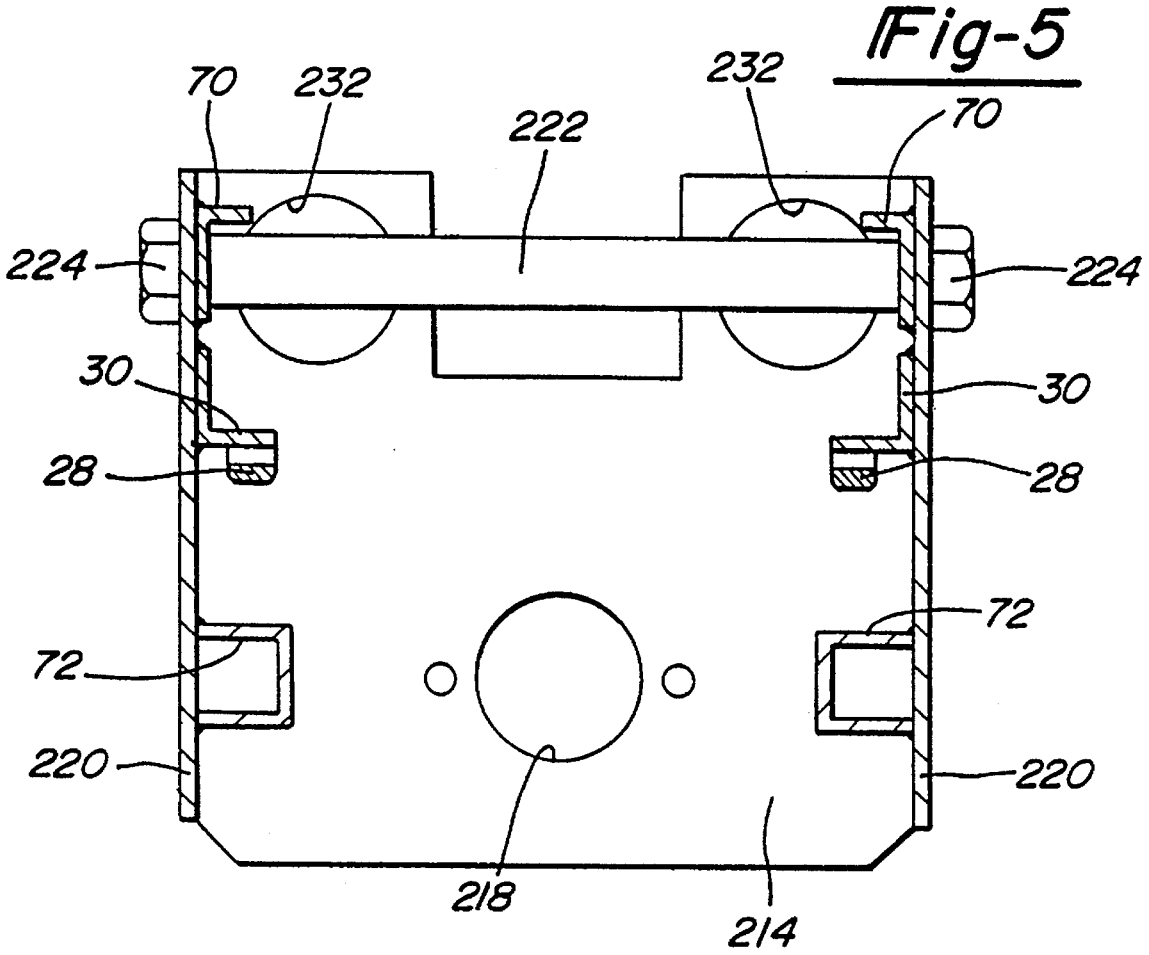
FIG. 5 is a sectional view taken substantially along the line 5—5 in FIG. 4 showing additional reinforcement structures which may be incorporated into the present.

As generally shown in FIG. 5, additional features are added to the frames 112 and 212 to enhance their structural characteristics. The added structural characteristics enable frames 112 and 212 of increased lengths to be used.

Applicants have found that for frames which are less twenty-two feet in length, the thickness of the side panels provide enough strength themselves so that no additional structural enhancements are needed. For lengths in excess of twenty-two feet, an additional support member 70 is added along the upper edge of the side panels 220. As seen in FIG. 5, the support members 70 are sections of angle iron welded in place so as to extend along the upper interior edges of both side panels 220. Depending on the specific positioning of the support members 70, the struts 222 may be located beneath, above, or at the support members 70, For frame lengths greater than thirty-four feet, in addition to the angle iron support members 70, a second support member 72, shown as a length of channel iron, is welded along an interior lower edge of each side panel 220. The additional structural enhancements enable the frame 212 to be constructed with side panels 220 of seamless construction and in lengths exceeding fifty feet.

While these enhancements are shown in connection with the second embodiment of the present invention, it is readily apparent that they are equally applicable to the construction of the first embodiment.

To assist in positioning the frames 112 and 212 relative to the boiler and other support structures, the frames 112 and 212 may be provided with various structures which will enable lifting of the frames 112 and 212 by a hook and cable suspended from a crane or other means. In the first embodiment, a removable lifting brace (not shown) may be secured between the side panels 120 and provided with upwardly extending ears or another mechanism for attachment. Similarly, the inboard end wall 114 can also provided with upwardly extending ears as designated at 130. When provided with attachment ears 130, the ears 130 are provided with openings 132 that enable hooks or another engagement structure to attach onto the frame 112 and hoist the frame 112 into position for securement. The ears 130 also enable the frame and sootblower 10 to be removed for replacement or servicing. In the alternative embodiment of FIGS. 4 and 5, instead of having ears 130, hoist openings 232 are formed directly in the inboard and outboard end walls 214 and 216.

FIGS. 6–11 show six further embodiments of the present invention. In the embodiments of FIGS. 6 and 8 through 11, the front and rear bulkheads of the embodiments have been omitted for the sake of clarity since they have been fully discussed in connection with the prior embodiments.

Figure 6:
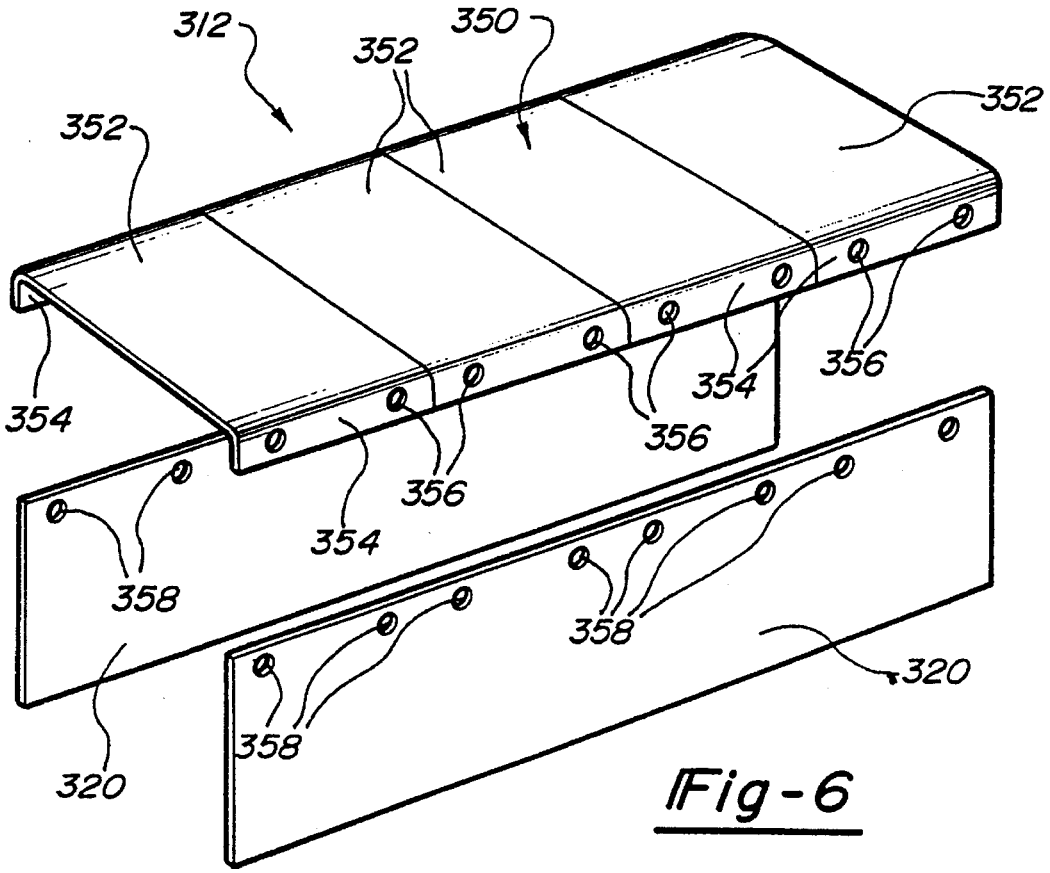
FIGS. 6–11 are exploded perspective views of six further embodiments of open sootblower frames according to the principles of the present invention.

Referring now to FIG. 6, the frame 312 illustrated therein utilizes side panels 320 formed of plate stock, as in the prior embodiments, but further includes a readily removable cover 350. The cover 350 operates to prevent the build-up of foreign deposits and encrustations on the carriage 18, lance tube 14 and gear rack 28, which allows for easier servicing of the sootblower 10 when necessary. The cover 350 also provides the sootblower 10 with increased structural integrity to assist in withstanding the various loads and forces placed upon the frame 312 during operation of the sootblower 10.

The cover 350 is composed of a multiple number of formed panels 352 having down turned end flanges 354. The end flanges 354 are provided to extend over the upper edges of the side panels 320 such that the cover panels 352 span thereacross. The cover panels 352 are additionally provided with apertures 356 that will, when the covers 352 are properly mounted, correspond with apertures 358 formed along the upper edges of the side panels 320. The apertures 356 and 358 are further configured to accept a quick release fastener (not shown), such as quarter turn thumb screws. In this embodiment, the number of cover panels 352 will vary depending upon the length of the frame 312. Also, the cover 350 is intended to remaining in place during operation of the sootblower 10. As such, the cover panels 352 can also be formed of sheet metal stock.

Figure 7:
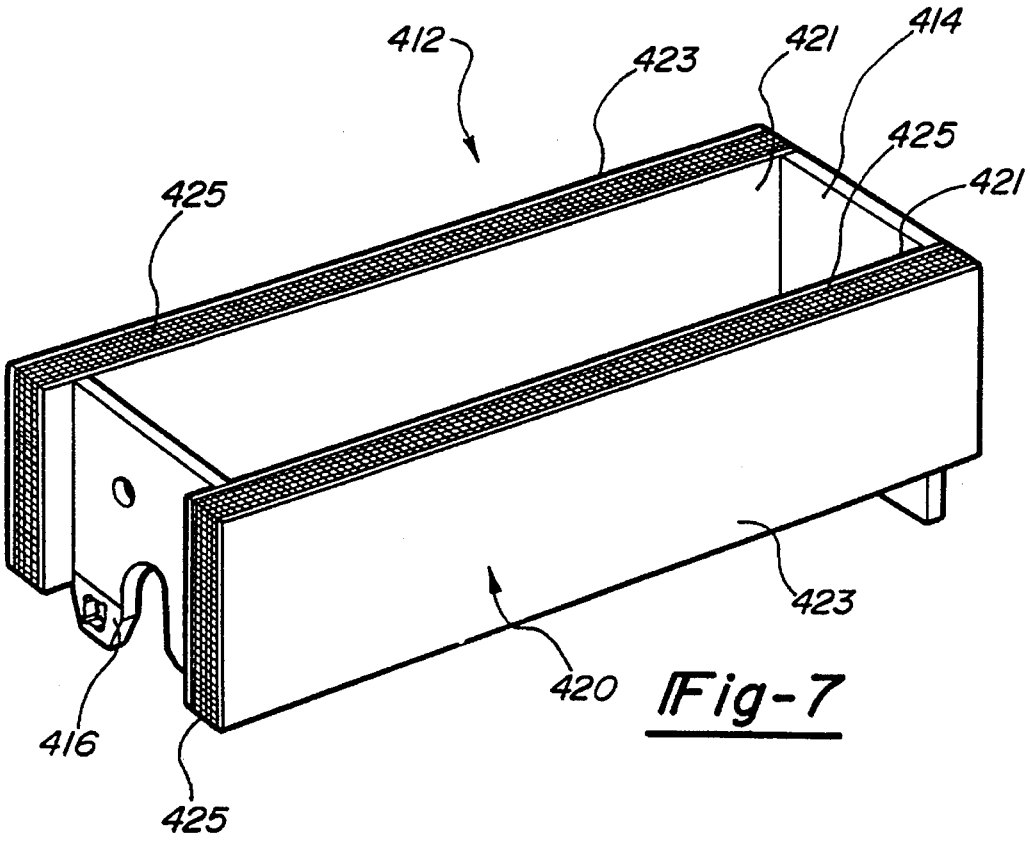

In the sootblower frame 412 shown in FIG. 7, the side panels 420 are of a composite construction. For each side panel 420, an interior and exterior panel 421 and 423, each made from thin sheet metal stock (preferably formed from stainless steel for corrosion purposes), enclose and are bonded to a rigid honeycomb structure 425. The honeycomb structure 425 is at least one inch thick and, as a result, increases the section modulus of the side panels 420 enhancing the rigidity of the side panels 420. The honeycomb structure 425 can be formed from a variety of materials. One such preferred material is rigid plastic foam which is foamed in place and adheres itself between the interior and exterior panels 421 and 423. Alternatively, the honeycomb structure 425 could be initially provided in a rigid form that is laminated to the interior and exterior panels 421 and 423.

Figure 8:
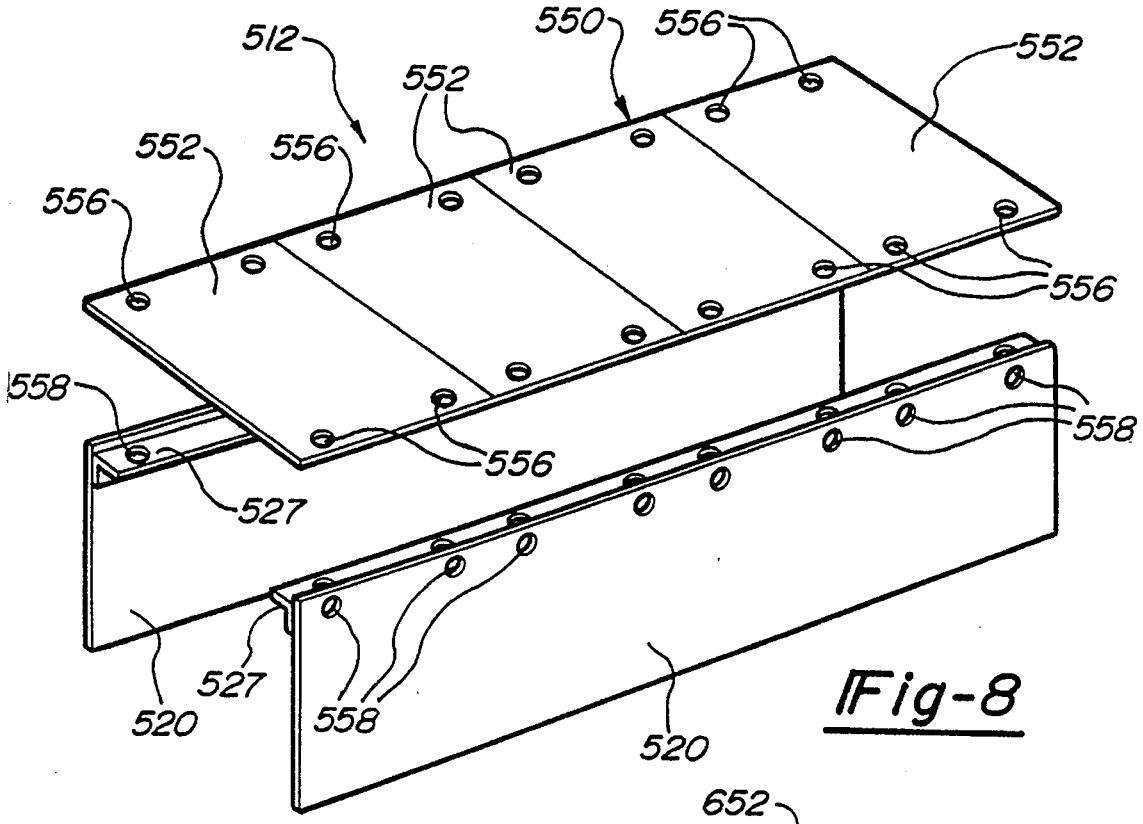

The embodiment of FIG. 8 illustrates a frame 512 in which the side panels 520 are formed from metal stock that has been provided with reinforcing members 527 along its interior upper edges. The reinforcing members 527 can be formed from a variety of materials and are illustrated as being sections of angle iron mounted to the side panels 520. The uppermost portion of the reinforcing members 527 provides a resting surface for receiving a flat, unformed cover 550. The cover 550 is removably mounted to the reinforcement members 527 and can be provided as a number of individual cover panels 552 to accommodate a variety of lengths and allow for easy removal during servicing of the sootblower. The cover panels 552 can be secured to the reinforcing members 527 through any common fastening method including the use fasteners such as bolts inserted through openings 556 and 558 respectively formed in each cover panel 552 and reinforcing member 527.

Figure 9:
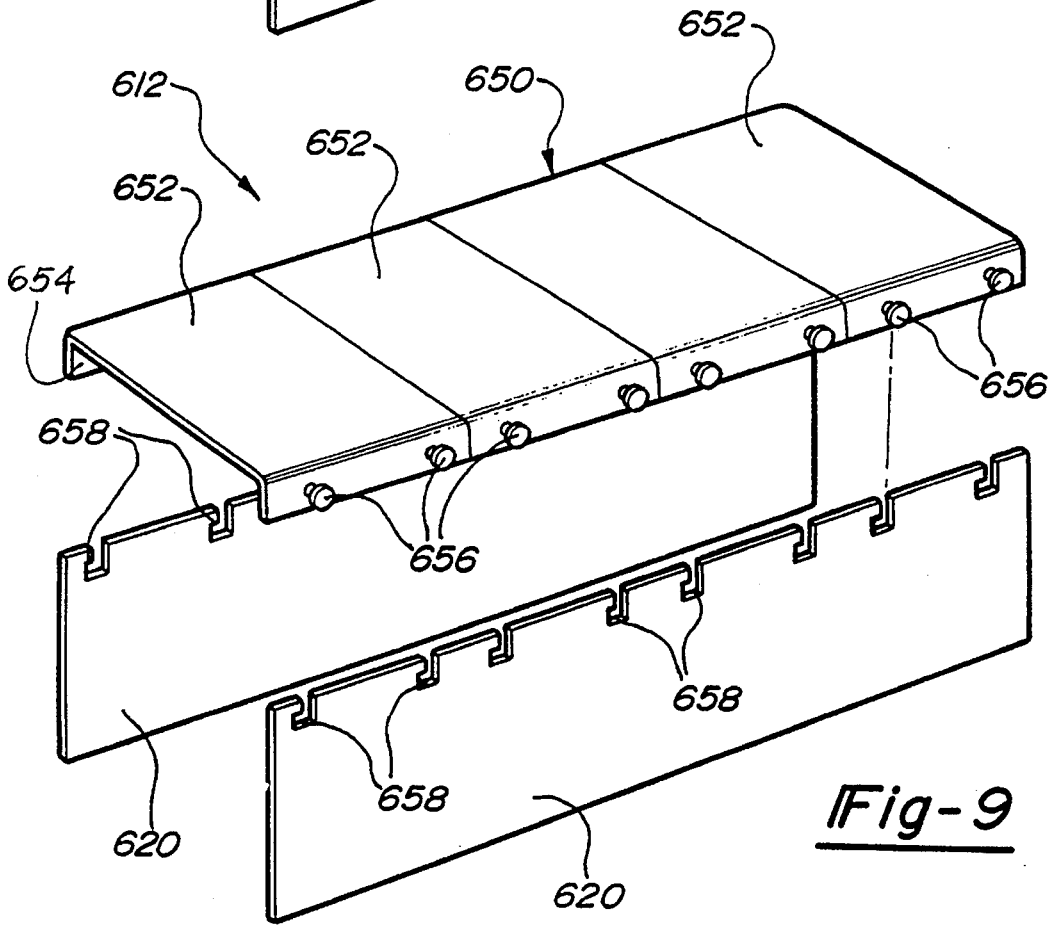

Referring now to FIG. 9, the frame 612 and cover 650 illustrated therein are intended to enable their assembly together without the use of loose or separate fasteners. The side panels 620 are therefore provided with J-slots 658, located along their upper edges, and adapted to receive tabs or buttons 656 provided on downwardly turned flanges 654 of the cover panels 652.

Figure 10:
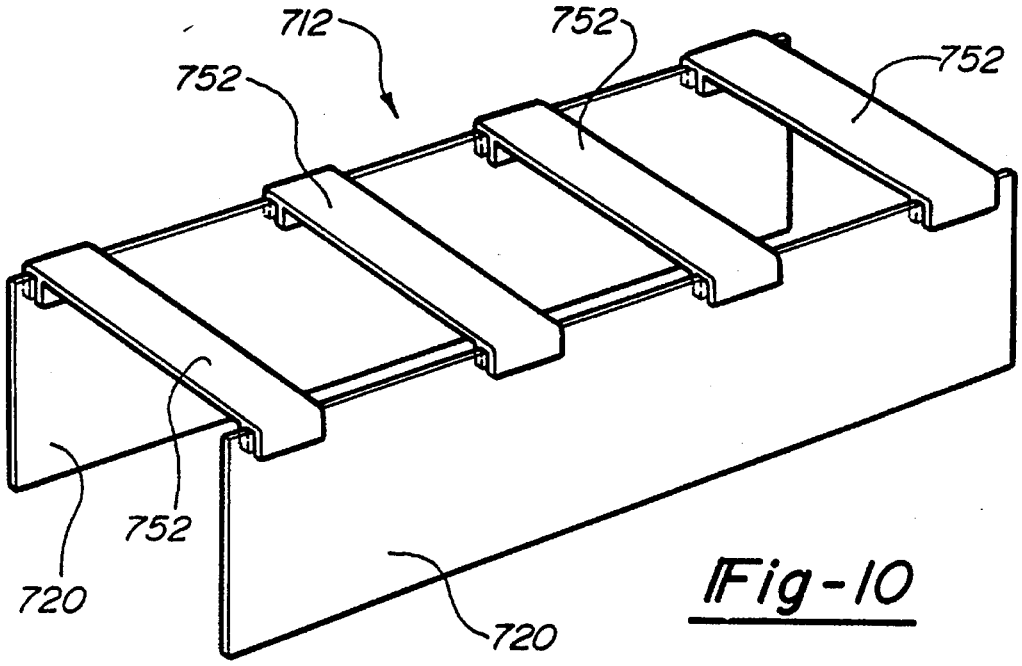

In FIG. 10, the embodiment of the frame 712 includes side panels 720 which are connected along their upper edges by transversely extending, drop-in-place reinforcing bars 752. The reinforcing bars 752 can be formed by extrusion or welding and include a pair of spaced apart downwardly turned fingers 754 on each end. The fingers 754 define a gap or slot which is wide enough to receive the side panel 720. Use of the drop-in reinforcing bars 752 described above eliminates the need for additional and separate fasteners which add to both the cost of the frame and the labor requirements of its installation. The reinforcing bars 752 are positioned along the length of the side panel 720, preferably at four or five foot intervals. If desired, covers (not shown) could also be incorporated over top of the reinforcing bars 752.

Figure 11:
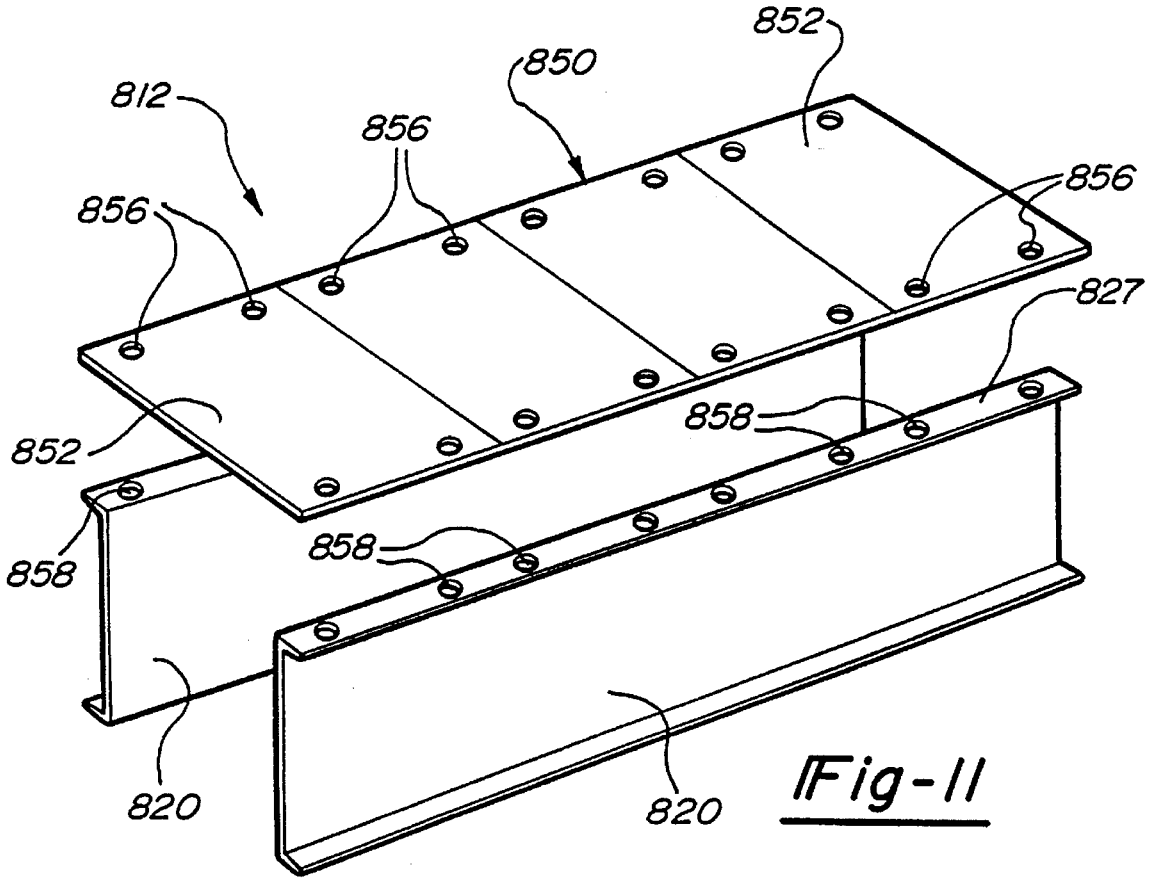

The frame 812, which can be seen in FIG. 11, includes side panels 820 formed out of lengths of channel members. The upper flange 827 of each side panel 820 is provided with apertures 858 along its length that enable a cover 850, again formed from a number of individual flat cover panels 852 and constructed from sheet metal stock, to be secured by conventional fasteners extended through apertures 856 in the cover 850 which correspond to the apertures 858 in the upper flange 827.

Another feature of the present invention is a drive carriage 18 configured to eliminate the lubrication problems caused by the high temperature of the blowing medium flowing through the lance hub 50.

Figure 12:
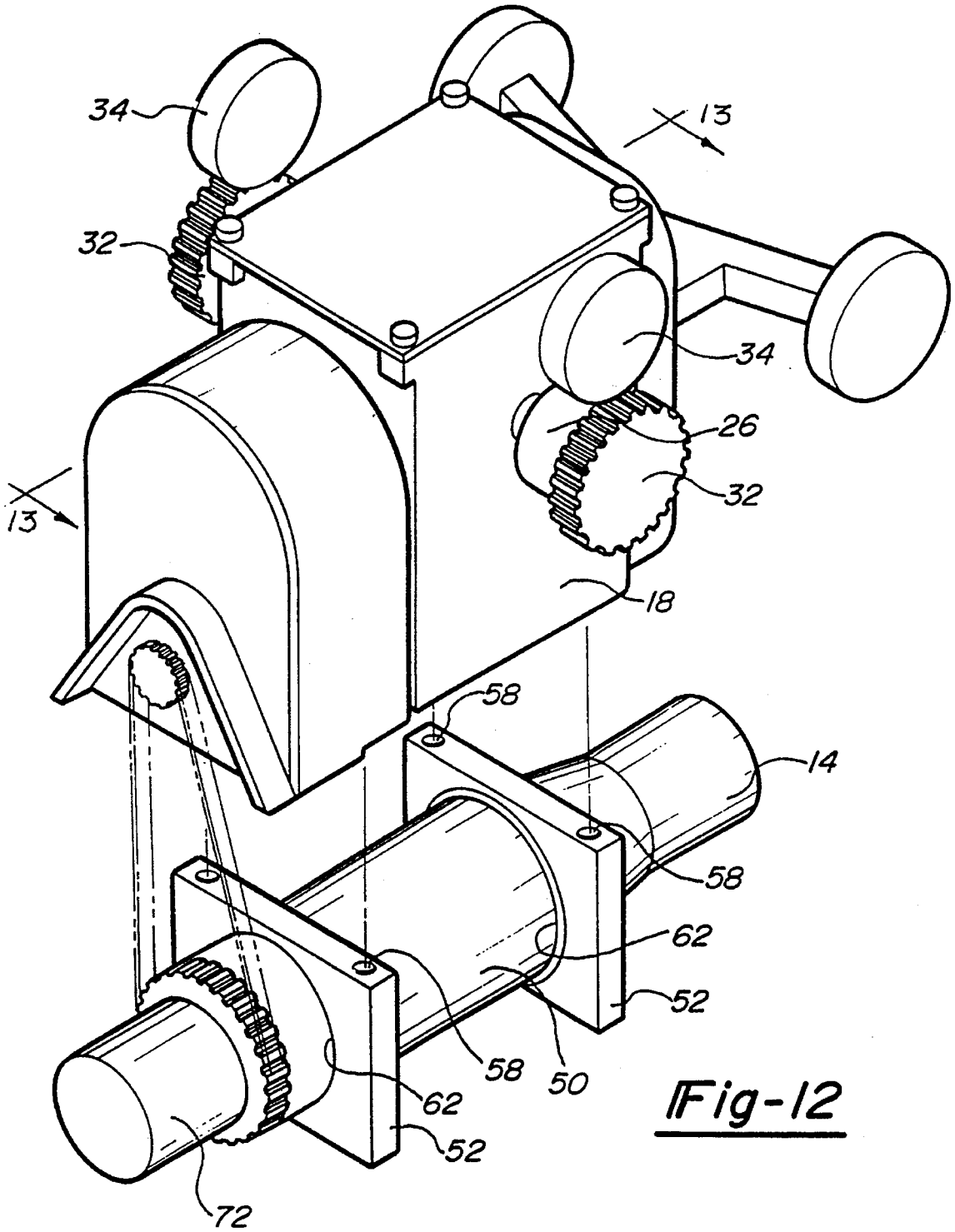
FIG. 12 is an exploded perspective view of a lance hub and carriage according to the principles of this invention.
Figure 13:
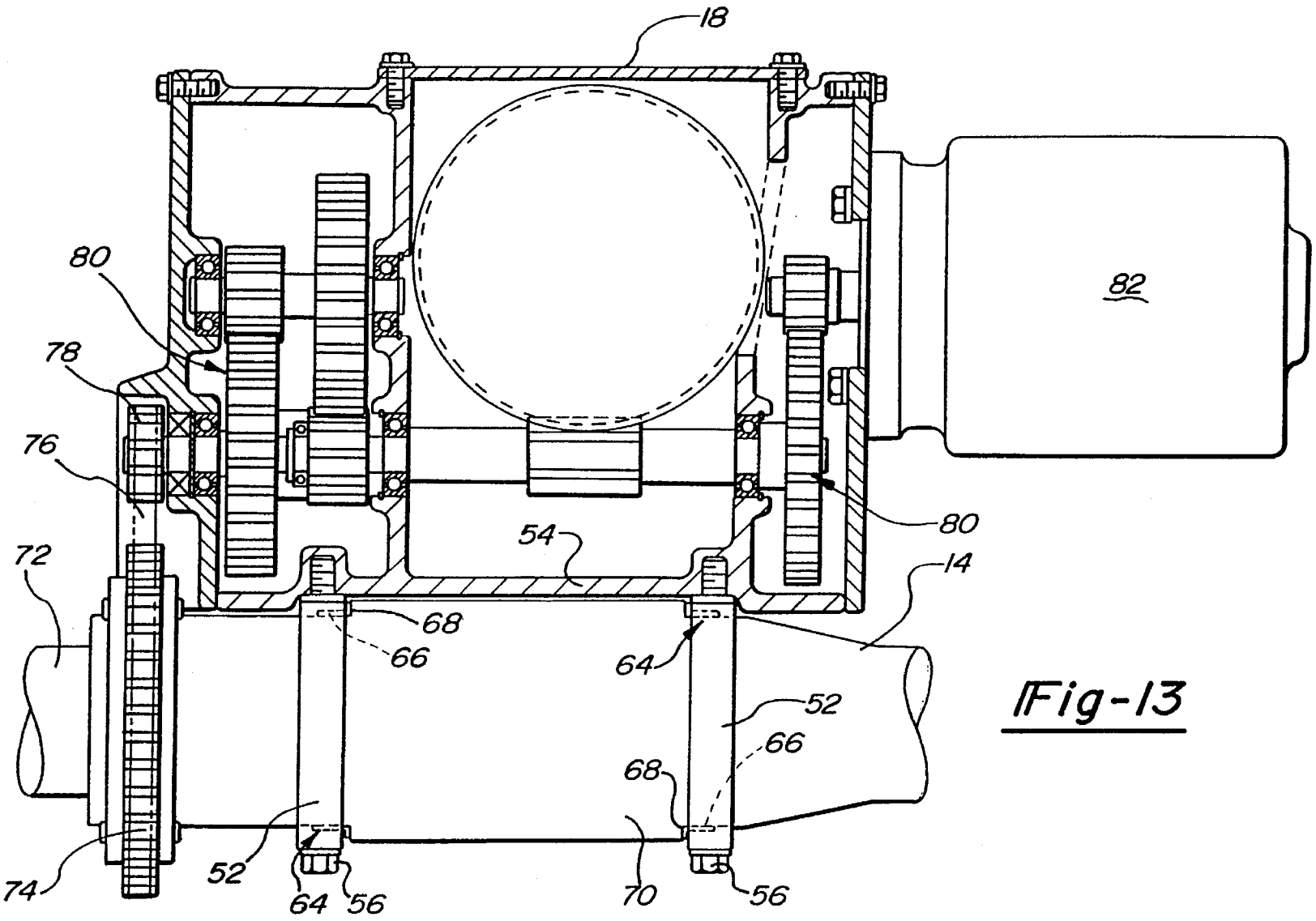
FIG. 13 is a sectional view taken substantially along line 13—13 in FIG. 12 further illustrating the dry lance hub of the present invention.

As seen in FIG. 12, the lance hub 50 of the sootblower 10 is supported in a position below the carriage housing 18. To accomplish this mounting, pillow blocks 52 are secured to the lowermost wall 54 of the carriage housing 18 by threaded fasteners 56. The fasteners 56 are extended through bores 58 in the pillow blocks 52 into threaded bores 60 formed in the lower wall 54 of the carriage housing 18. Each pillow block 52 includes a central aperture 62 which receives a bushing 64. Preferably, the bushing 64 is constructed from a material which will withstand the high temperatures associated with the lance hub 52 and which does not require external or supplemental lubrication. One such material is polyiamde plastic.

Each bushing 64 includes a general cylindrical portion 66 from which extends an annular radial portion 68. The radial portion 68 allows the bushings 64 to positively seat within the apertures 62 defined in the pillow blocks 52. To retain the lance hub 50 in the pillow blocks 52, the lance hub 50 is configured with a shoulder 70 that corresponds in shape to the bushing 64 allows the lance hub 50 to be captured between the pillow blocks 52.

When mounted in the manner described above, the positioning of the lance hub 50 enhances the convective dissipation of heat generated by the blowing medium being delivered from a feed tube 72 to the lance tube 14 for boiler cleaning. The bushings 64 not only allow for rotation of the lance hub 50, which is rigidly connected to the lance tube 14, but they also constrain the thrust loads generated by the discharge of the blowing medium. As seen in the figures, in order to rotate the lance hub 50 and lance tube 14, a gear ring 74 is mounted on the lance hub 50 and coupled by a belt or chain 76 to a drive gear 78 of the translational and rotational transmission, generally designated at 80. The transmission 80 is driven by a motor 82 provided on the sootblower 10.

By locating the lance hub 50 in an isolated position on the exterior of the carriage housing 18, it can be seen that any lubricant within the carriage housing 18 which is used to lubricate the transmission 80 will not be significantly affected by heat generated by the blowing medium. The heat from the lance hub 50 is convectively dissipated into the ambient atmosphere in an enhanced manner. As a result of the enhanced convective dissipation of heat and the use of the plastic bushings 64, transfer through the pillow blocks to the lubricant is negligible. The isolation and dissipation of the heat generated through the lance 50 further results in a decrease in the frequency with which the lubricant within the carriage housing 18 need to be serviced. Also, there is no longer a need to service or lubricate bearings associated with the lance hub 50. Instead, the only time the lance hub 50 will need to be serviced is when the bushings 64 need to be completely replaced.

While the above description constitutes the preferred embodiments of the present invention, it will be appreciated that the invention is susceptible to modification, variation and change without departing from the proper scope and fair meaning of the accompanying claims.

We claim:

1. A retractable sootblower for cleaning interior surfaces of a boiler, said sootblower comprising a lance tube, a feed tube, supply means for providing a blowing medium through said feed tub to said lance tube, a carriage assembly including a housing and transmission means coupled to said lance tube enclosed within said housing for advancing and retracting said lance tube into and out of the boiler, a lubrication system associated with and lubricating said transmission means, a frame supporting said carriage assembly and being located adjacent to the boiler, a lance hub supporting said lance tube and coupling said lance tube to said transmission means, said carriage assembly also including support means for rotatably supporting said lance hub and enhancing convective dissipation to ambient air of heat generated within said lance hub by the transmission of said blowing medium therethrough, said support means being independent of and isolated from said lubrication system.

2. The retractable sootblower as set forth in claim 1 wherein said lance hub is supported exteriorly of said housing by said support means.

3. The retractable sootblower as set forth in claim 1 wherein said lubrication system is located interiorly of said housing and said lance hub is supported exteriorly of said housing by said support means.

4. The retractable sootblower as set forth in claim 1 wherein said support means includes support members secured to said housing and having apertures defined therein, said apertures being configured to receive said lance hub and permit rotation of said lance hub while constraining axial movement of said lance hub.

5. A retractable sootblower for cleaning interior surfaces of a boiler, said sootblower comprising a lance tube, a feed tube, supply means for providing a blowing medium through said feed tube to said lance tube, a carriage assembly including a housing and transmission means coupled to said lance tube enclosed within said housing for advancing and retracting said lance tube into and out of the boiler, a lubrication system associated with and lubricating said transmission means, a frame supporting said carriage assembly and being located adjacent to the boiler, a lance hub supporting said lance tube and coupling said lance tube to said transmission means, said carriage assembly also including support means for rotatably supporting said lance hub and enhancing convective dissipation to ambient air of heat generated within said lance hub by the transmission of said blowing medium therethrough, said support means being independent of and isolated from said lubrication system, and including support members secured to said housing and having apertures defined therein, said apertures configured to receive said lance hub and permit rotation of said lance hub while constraining axial movement of said lance hub, said support members being pillow blocks.

6. A retractable sootblower for cleaning interior surfaces of a boiler, said sootblower comprising a lance tube, a feed tube, supply means for providing a blowing medium through said feed tube to said lance tube, a carriage assembly including a housing and transmission means coupled to said lance tube enclosed within said housing for advancing and retracting said lance tube into and out of the boiler, a lubrication system associated with and lubricating said transmission means, a frame supporting said carriage assembly and being located adjacent to the boiler, a lance hub supporting said lance tube and coupling said lance tube to said transmission means, said carriage assembly also including support means for rotatably supporting said lance hub and enhancing convective dissipation to ambient air of heat generated within said lance hub by the transmission of said blowing medium therethrough said support means being independent of and isolated from said lubrication system, and including support members secured to said housing and having apertures defined therein, said apertures configured to receive said lance hub and permit rotation of said lance hub while constraining axial movement of said lance hub, said apertures defining a bearing surface upon which said lance hub is received.

7. The retractable sootblower as set forth in claim 6 wherein said bearing surfaces are defined by bushings received in said apertures.

8. The retractable sootblower as set forth in claim 7 wherein said bushings are made of a plastic having a high temperature resistance.

9. The retractable sootblower as set forth in claim 8 wherein said bushings include a cylindrical portion having a radial flange extending therefrom, said cylindrical portion being substantially coaxial with said lance hub and said flange retaining axial movement of said lance hub.

10. The retractable sootblower as set forth in claim 1 wherein said support means rotatably supports said lance hub without fluid lubrication therebetween.

11. A retractable sootblower as set forth in claim 1 wherein said support means includes a support member in contact with said lance hub to permit relative rotational movement therebetween.

12. A retractable sootblower as set forth in claim 1 wherein said support member is constructed of a material having inherent lubricity.

* * * * *

UNITED STATES PATENT AND TRADEMARK OFFICE

CERTIFICATE OF CORRECTION

PATENT NO. : 5,549,079
DATED : August 27, 1996
INVENTOR(S) : Johnston, Jr. et al.

It is certified that error appears in the above-indentified patent and that said Letters Patent is hereby corrected as shown below:

Title page, item
(63) please delete "Pat. No. 5,421,076" and insert —Pat. No. 5,429,076—

Signed and Sealed this
Nineteenth Day of November, 1996

Bruce Lehman

*Attest:*

BRUCE LEHMAN

*Attesting Officer*

*Commissioner of Patents and Trademarks*